United States Patent [19]

Lueckenotte et al.

[11] Patent Number: 4,624,685

[45] Date of Patent: Nov. 25, 1986

[54] METHOD AND APPARATUS FOR OPTIMIZING POWER CONSUMPTION IN AN ELECTROSTATIC PRECIPITATOR

[75] Inventors: Donald L. Lueckenotte, Blue Springs, Mo.; Robert P. Kaltenbach, Mission, Kans.

[73] Assignee: Burns & McDonnell Engineering Co., Inc., Kansas City, Mo.

[21] Appl. No.: 688,962

[22] Filed: Jan. 4, 1985

[51] Int. Cl.[4] ..... B03C 3/00

[52] U.S. Cl. ..... 55/13; 55/105; 55/106; 323/903; 364/483; 364/500

[58] Field of Search ..... 55/13, 112, 105, 106, 55/139; 323/903; 364/483, 500

[56] References Cited

U.S. PATENT DOCUMENTS

| | | | |
|---|---|---|---|
| 1,070,556 | 8/1913 | Strong | 55/104 |
| 2,200,085 | 5/1940 | Hildebrand | 55/104 |
| 3,039,252 | 6/1962 | Guldemand | 55/105 |
| 3,488,675 | 1/1970 | Eishold | 55/105 |
| 4,218,225 | 8/1980 | Kirchoff et al. | 55/112 |
| 4,284,417 | 8/1981 | Reese et al. | 55/105 |
| 4,432,062 | 2/1984 | Herklotz | 55/112 |
| 4,502,002 | 2/1985 | Ando | 55/105 |
| 4,521,228 | 6/1985 | Daar et al. | 55/105 |

FOREIGN PATENT DOCUMENTS

| | | | |
|---|---|---|---|
| 3048979 | 10/1982 | Fed. Rep. of Germany | 55/105 |
| 498018 | 3/1976 | U.S.S.R. | 55/105 |
| 1012952 | 4/1983 | U.S.S.R. | 55/106 |

*Primary Examiner*—Bernard Nozick

*Attorney, Agent, or Firm*—Shlesinger, Arkwright, Garvey & Fado

[57] ABSTRACT

A process for optimizing the power consumption of electrostatic precipitators communicating with a boiler or the like includes a load indexed signal fed forward to a field power controller to approximate the required power levels. An optical transducer is provided in the boiler stack for monitoring the emissions therefrom and feeds back a signal to the controller proportional to the emission from the stack to trim the power level. The controller incrementally adjusts the field power by comparing the opacity generated signal to a continuously optimized limit in order to thereby optimize the power consumption by lowering and raising the field power in response to changes in the opacity. The measurement of power permits the process to be extended to include supervision of electrode cleaning, compensation for fields out of service and flow balancing.

40 Claims, 6 Drawing Figures

TYPICAL OUTLET DUST LOADING (LB/100 MW)
128.0
38.0
25.0
TYPICAL OPACITY
25
20
15
10
5
FULL LOAD
66
80% LOAD
64
62
60% LOAD
0
100
200
300
400
500
PRECIPITATOR INPUT POWER
(KW/100 MW RATING)

METHOD AND APPARATUS FOR OPTIMIZING POWER CONSUMPTION IN AN ELECTROSTATIC PRECIPITATOR

BACKGROUND OF THE INVENTION

The disclosed invention is advantageously utilized to provide automatic control for achieving the optimal distribution of electric power within an electrostatic precipitator while maintaining acceptable environmental standards. An electrostatic precipitator utilizes high voltage electrodes to charge particulate matter in a high voltage or corona field. The charging voltage is further used to collect the charged particles on the oppositely charged electrodes of the precipitator. Periodic rapping of the electrodes is usually required to loosen the particulates and to thereby maintain the operating efficiency of the precipitator.

A typical electrostatic precipitator utilizes a plurality of paired oppositely charged electrodes disposed, at least in part, in the flue gas flow path. The electrodes are usually arranged in groups or fields. A transformer-recitifer (T-R) set provides power to a field, to several fields or to a portion of a field and is used to generate the corona power between the paired electrodes.

Field voltage, hence corona power, is regulated and controlled by the amount of current provided by a regulator to each T-R set. Dedicated control for each T-R set is normally provided. Dedicated control of each T-R set permits independent energization of each field in order to enhance the collection of the particulates. Additionally, independent energization of the fields permits profiling of the precipitator fields in order to optimize the collection of particulates by the various fields.

Prior art control techniques have frequently sought to maintain the field voltage at a high voltage that is close to the "sparking limit" of the field. The field voltage is thereby maintained at maximun power regardless of whether maximum power is necessary. Consequently, the extra power is wasted and needlessly increases the operating costs of the precipitator. Experience has shown that the power requirement is related to many factors, such as: flue gas flow, particulate loading and the temperature of the flue gas, among others.

The continuing increase in the cost of electricity, which is utilized to energize the individual fields of the precipitator, has brought forth a need to optimize power consumption while still attaining particulate emission levels at their design limits and as mandated by environmental regulations. Manual adjustment of the individual T-R sets can provide some power reduction but control by this means is extremely inexact.

Reese, et al., U.S. Pat. No. 4,284,417, discloses one method for controlling the electric power supplied to an electrostatic precipitator. Reese discloses the utilization of an opacity transducer adapted for monitoring the opacity of the flue gas exiting the precipitator. Reese discloses that the power to the precipitator may be regulated so that the opacity remains just below the established environmental guidelines. Reese fails to realize, however, that major reductions in opacity are achieveable for minor increases in corona power to a point of optimum power utilization. Consequently, relatively minor increases in power can provide a cleaner environment at a reasonable cost. Reese attempts to achieve an opacity level just short of that required rather than attempting to remove the maximum amount of particulates from the stream. Reese fails to appreciate the downstream effects and costs occasioned by the large quantity of particulates remaining in the flue gas stream.

OBJECTS AND SUMMARY OF THE INVENTION

The primary object of the disclosed invention is to provide a method and appartus for optimizing the power consumption of electrostatic precipitators through utilization of a load indexed feed forward signal and a particulate loading feedback signal.

A further object of the disclosed invention is to provide means for accommodating linear and non-linear load transients.

Yet a further object of the disclosed invention is to provide a method and apparatus for automatically seeking the optimal power level.

Still a further object of the disclosed invention is to utilize the particulate loading feedback signal to trim the power of the field wherein the power is primarily derived from the load indexed feed forward signal.

Yet another object of the disclosed invention is to provide automatic means for determining the buildup of particulates on the electrodes and for providing automatic means for cleaning the electrodes while simultaneously compensating for any out of service electrodes.

Still yet another object of the disclosed invention is to provide a precipitator control apparatus and method adapted for minimizing particulate emissions and simultaneousy optimizing power consumption while still attaining environmental guidelines.

Yet a further object of the disclosed invention is to provide an apparatus and method for controlling a precipitator which may be retrofitted to an existing precipitator control apparatus.

Another object of the disclosed invention is to provide a precipitator control apparatus and method which is expandable and which may be assembled from a minimum number of readily available parts.

A further object of the disclosed invention is to provide a method and apparatus for profiling the precipitator fields.

Another object of the disclosed invention is to provide a method and apparatus which automatically trims the field voltage until the opacity increases by more than a preselected amount.

In summary, the disclosed invention is advantageously adapted for controlling the power consumption of an electrostatic precipitator utilized in conjunction with a boiler, or the like, which discharges particulate laden flue gas to a smokestack. A transformer-rectifier set provides the corona power for the precipitator and an adjustable primary controller is connected to the transformer-rectifier set in order to regulate the power output thereof. A load indexed signal is fed forward from the boiler to the primary controller in order to establish the primary corona power. A particulate loading signal is fed back from the smokestack to the primary controller in order to trim the corona power to a level where the particulate loading of flue gas increases by more than a predetermined amount. The offset limit is normally set at the point of optimization, but the level can be set so as to be just sufficient to permit the precipitator to attain the particulate emission standards. The invention achieves the stated objectives of minimizing particulate emission while optimizing the power consumption through utilization of a low seeking algorithm which cooperates with the opacity monitor.

A power to voltage or current comparator compares the corona voltage to the voltage demand indicated by the transformer-recitifier set in order to monitor the build-up of particulates on the electrodes of the various fields. An increase in current or a decrease in voltage while field power is held constant provides an accurate means for determining particulate build-up. When the particulates have built up beyond a predetermined level, then means are initiated for automatically rapping or cleaning the electrodes.

These and other objects and advantages of the invention will be readily apparent in view of the following description and drawings of the above-described invention.

DESCRIPTION OF THE DRAWINGS

The above and other objects and advantages and novel features of the present invention will become apparent from the following detailed description of the preferred embodiment of the invention illustrated in the drawings, wherein.

DESCRIPTION OF THE INVENTION

Figure 1:
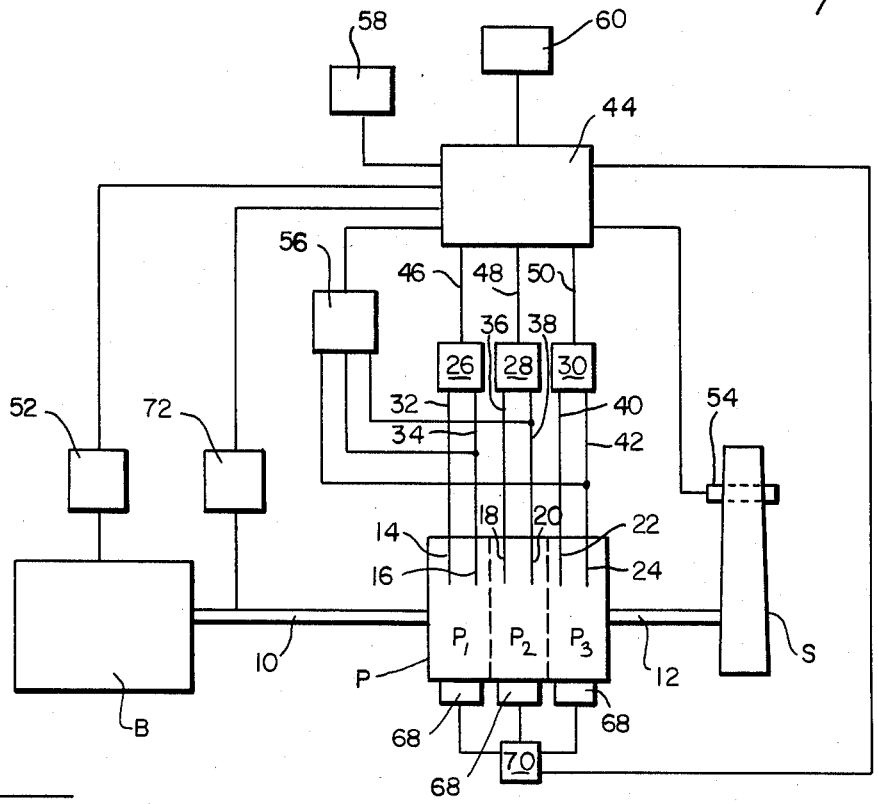
FIG. 1 is a schematic diagram of the invention.

As best shown in FIG. 1, coal fired boiler B has an exhaust duct 10 communicating particulate laden flue gas to precipitator P. Stack or exhaust device S is in communication with precipitator P by means of duct 12 which conveys the cleaned flue gas from precipitator P to stack S.

While the boiler B has been disclosed as being a coal fired boiler, one skilled in the art can appreciate that various other particulate and energy sources are known in the art for powering a boiler, a generator, a kiln, a smelter or the like. The boiler B, regardless of the media being combusted, is adapted for combusting the material in order to achieve a desired purpose, such as the generation of electric power, steam or the like. The combustion of the energy source requires the utilization of air, as is well known, with the result that large quantities of particulate laden flue gas are generated.

Environmental regulations and statutes limit the overall quantity and the loading of particulates emitted from any particulate source, such as from boiler B. Control of particulates exhausted through stack S is therefore of prime concern to the operators of boiler B, whether it be a boiler or other particulate source.

The precipitator P is, preferably, divided into a plurality of fields P1, P2 and P3. Those skilled in the art can appreciate that the precipitator P will typically have more than three fields and that the fields P1, P2 and P3 are merely illustrative. Each field includes at least one pair of oppositely charged electrodes which generate the corona power for charging the particulate material. Field P1 has electrodes 14 and 16 while field P2 has electrodes 18 and 20 and field P3 has electrodes 22 and 24. Each of the electrodes 14–24 is connected one of to a transformer-rectifier (T-R) sets 26, 28 and 30, respectively. Leads 32 and 34 connect electrodes 14 and 16. respectively, to T-R set 26. Similarly, leads 36 and 38 connect electrodes 18 and 20, respectively, to T-R set 28 while leads 40 and 42 connect electrodes 22 and 24, respectively, to T-R set 30. Those skilled in the art can appreciate that each of the pair of leads 32–42 are utilized to provide voltage to the associated electrodes 14–24. The electrodes 14–24 of each field P1, P2 and P3 each have their own voltage sign and thereby provide oppositely charged paired electrodes. Charging of particulates by one of the electrodes of a pair causes the particulates so charged to be attracted to the oppositely charged electrode with the result that particulates are removed from the flue gas stream.

The charging voltage between each of the cooperating pairs of electrodes 14–16, 18–20 and 22–24 must be sufficiently high to charge and collect the charged particulates on the oppositely charged electrodes within the precipitator fields P1, P2 and P3. For this reason, adjustable output primary controller 44 is connected to each of the T-R sets 26–30 by means of leads 46, 48 and 50. In this way, the primary controller can direct current to each of the T-R sets 26–30 in order to regulate the power to the fields P1, P2 and P3. Regulation and adjustment of the current fed to each of the T-R sets 26–30 results in the regulation and adjustment of the corona power between the electrodes 14–24 of the fields P1, P2 and P3.

As best shown in FIG. 1, primary supervisory controller 44 is in electrical connection with transformer-rectifiers sets 26–30. The transformer-rectifier sets 26–30 each includes a voltage, current, or phase angle control adapted for energizing the electrodes of the fields P1, P2 and P3 of the precipitator P by generating a field voltage in response to a control signal sent by the primary controller 44.

Load indexed transducer 52 is operatively associated with boiler B and is in electrical connection with primary controller 44. One or more transducers 52, which is of a type well known in the art, is adapted for monitoring any one or all of the following load transients: volumetric flue gas flow, volumetric steam flow, volumetric air flow and volumetric fuel flow. Similarly, transducer 52 or an additional transducer or controller may be utilized to correct the load indexed signal for particulate resistivity, ash loading, and flue gas temperature. The above cited transients and input to boiler B are only a representative list of the parameters which may be monitored. Those skilled in the art can appreciate that the significance of these, as well of other parameters, is, to a large extent, dependent upon the application to which the boiler B is placed.

Additionally, the above and other load parameters or transients may be of a linear or a non-linear relationship. That is, particulate loading is based, at least in part, on fuel loading and fuel loading is not necessarily continuous and uniform. Consequently, particulate loading may exhibit both linear and non-linear relationships at various times.

The transducer 52 monitors the parameters or transients and feeds forward a dynamic signal to the controller 44 which signal is indicative of, and generally proportional to, the parameter or parameters being monitored. The transducer 52, preferably, includes means for providing a time delay to permit a lag time to be built into the monitoring system. It should be obvious that, due to the large number of parameters being monitored, a modern electronic digital or analog data collection system is preferred for use with the transducer 52 to facilitate data collection.

An optical transducer 54 is operatively associated with stack S and is adapted to monitor the opacity of the flue gas exiting precipitator P through stack S. The transducer 54 generates a dynamic signal indicative of, and preferably proportional to, the opacity level or particulate loading of the flue gas issuing from stack S. The transducer 54 is in electrical communication with primary controller 44 and is adapted for transmitting the dynamic signal to controller 44. Consequently, the transducer 54 feeds back a particulate loading signal to the controller 44. While an opacity transducer 54 has been disclosed, those skilled in the art can appreciate that other particulate loading monitor means may be adapted for utilization with the invention.

A power monitor 56 is in electrical connection with the electrodes 14–24 of the precipitator P and with the primary controller 44. The power monitor 56 monitors the corona power between the paired electrodes 14–24 of the precipitator fields P1, P2 and P3. The charged particulates are drawn to and attached to the electrodes 14–24 of each of the precipitator P and thereby affect the voltage and current relationship existing between the electrodes as the power is held constant.

Monitoring the voltage or current change for each field in relation to the power permits a determination to be made of the quantity of particulates which have become attached to the electrodes 14–24 of the precipitator P. Also, monitoring of the voltage or current rate of change in comparison with the power permits an accurate determination of the rate of particulate build-up to be made. The comparison of the rate of particulate build-up in one of the fields P1, P2 and P3 with a similar measurement in the other parallel flow path fields permits a determination to be made of any flow or particulate loading imbalance between the flow paths. This in turn permits the power to each flow path to be biased in order to compensate for the flow imbalances.

The load indexed transducer 52 transmits its dynamic signal to primary controller 44. Controller 44 interprets the received signal and directs T-R sets 26–30 to provide a particular corona power dependent upon the signal received. Consequently, the initial corona power is proportional to the initial load parameter or parameters being monitored. The primary controller 44 receives the load indexed signal from transducer 52 and interprets the signal received with regard to the particulate level which must be achieved by the precipitator P and determines the power necessary for the precipitator P to attain that level.

The Deutsch-Anderson model is one means which may be utilized to approximate the corona power which is required. The Deutsch-Anderson model may be mathematically expressed as:

$$\beta = 100(1 - e(-AW/V))K$$

where $\beta$ = particulate removal efficency (%)
A = total collecting area ($FT^2$)
V = volumetric flow ($FT^3$/min)
W = migration velocity (FT/min)
K = empirical correlation factor The Deutsch-Anderson model determines particulate removal efficiency based upon the total area of the electrodes, the volumetric flow rate, the migration velocity and an empirical correlation factor.

The migration velocity may be determined from Cunningham's correction to Stoke's law. Cunningham's correction may be mathematically expressed as:

$$W = (qEp/6\pi\theta)a\ (1 + \alpha(\lambda/a))$$

where
W = migration velocity
q = particle charge
Ep = precipitator field voltage
$\theta$ = gas viscosity
a = particle radius
$\lambda$ = mean free path length
$\alpha$ dimensionless parameter Cunningham's correction bases migration velocity on the particle charge, the precipitator field voltage, the gas viscosity, the particle radius, the mean free path length and a dimensionless parameter. Consequently, the primary controller 44, which preferably includes a microprocessor or other modern electronic computing means adapted for performing the necessary arithmetic operations, calculates and determines the required corona power taking into account the Deutsch-Anderson model and Cunningham's correction.

The inventors have learned, through experimentation, however, that the Deutsch-Anderson model suffers from a lack of accuracy as the corona power increases. Specifically, the Deutsch-Anderson model suggests that the removal efficiency increases with increasing corona power. Consequently, increasing corona power should result in increasing removal efficiency. Unfortunately, the results indicate otherwise.

For instance, the empirical correlation factor K permits the reentrainment of particulates due to electrode cleaning to be taken into account. Additionally, the empirical correlation factor K also takes into account turbulence or other flow disturbing occurences. Since cleaning occurs periodically, the Deutsch-Anderson model need only take those factors into account during the cleaning period. The Deutsch-Anderson model also fails to take into account electrode end sneakage and rear field reentrainment. The latter two deviations account for a substantial portion of the stack particulates and cannot be overcome by increasing the corona power.

A more accurate approximation of the required corona power can be obtained by an empirical determination based upon repeated testing, particularly at high voltages, and monitoring of the obtained load indexed and particulate loading signals. The particulate testing required is of a type well known in the art and merely requires a manual adjustment of T-R sets 26–30 in cooperation with the feedback signal from the transducer 54 and the feed forward signal from transducer 52. A sufficient number of tests at various load levels permits accurate power approximation to be made for those ranges where the Deutsch-Anderson model breaks down. These tests can also be utilized with modern computer techniques in order to fit the Deutsch-Anderson model and to provide for proper nominal power distribution within the precipitator.

The opacity transducer 54 feeds back a signal to primary controller 44 which is utilized for trimming the corona power of the electrodes 14–24 of the precipitator P. The primary controller 44 utilizes a low-seeking algorithm in order to adjust the corona power based upon particulate loading the measured opacity as monitored by the transducer 54. The corona power is decreased by the controller 44 until such time as a marginal decrease in corona power results in the opacity increasing by more than a predetermined particulate offset amount. The controller 44 monitors the resulting opacity and compares that opacity to both an environmental limit for particulates a setpoint which is derived by adding together a previously obtained low opacity with the offset. The controller 44 adjusts the corona power of the electrodes 14–24 based upon the results of the comparison with the result that the corona power is again incrementally reduced if the opacity is less than the setpoint. On the other hand, should the measured opacity exceed the setpoint or the environmental limit, for particulates then the corona power is incrementally increased. Consequently, the measured opacity is capable of being maintained at an optimal level well below the environmental limit for particulates and thereby provides maximum environmental protection. Consequently, the primary controller 44 will reduce the corona power in order to conserve electricity. Additionally, should the measured opacity exceed the environmental limit, then a backup in the primary controller 44 will raise the corona power. One skilled in the art can appreciate that monitoring of the opacity in cooperation with the load indexed transducer 52 results in the corona power being continuously adjusted in order to achieve the minimal power level required for obtaining the maximum environmental protection.

As best shown in FIG. 1, data input device 58 is in electrical connection with controller 44. The data input device 58 is utilized by the operator (not shown) in order to input the particulate offset and the environmental limit for particulates. Consequently, the operator (not shown) can select the amount of offset which is to be utilized by the controller 44 in determining whether or not to increase or decrease the corona power. Typically, the particulate offset should be set in a range of approximately 0.25%, for reasons to be explained herein later.

Storage device 60 is in electrical connection with controller 44 and is utilized by the controller 44 to store the particulate offset and the environmental limit for particulates, among other things. Additionally, the storage device 60, which preferably is a volatile memory, is utilized to store a previously achieved low opacity level utilized in calculating the setpoint. The controller 44 stores in the storage device 60 the lowest previously obtained opacity level in order to provide a target or reference level. The storage device 60 must permit the stored opacity level to be replaced, it must be writeable, due to the fact that marginal changes in the corona power and transients in the boiler load parameters may result in the stored low opacity being subject to change. Those skilled in the art can appreciate that the storage device 60 and data input device 58 can, preferably, be integrated into the controller 44. Specifically, a modern computing system can be advantageously utilized to effect such integration.

Figure 5:
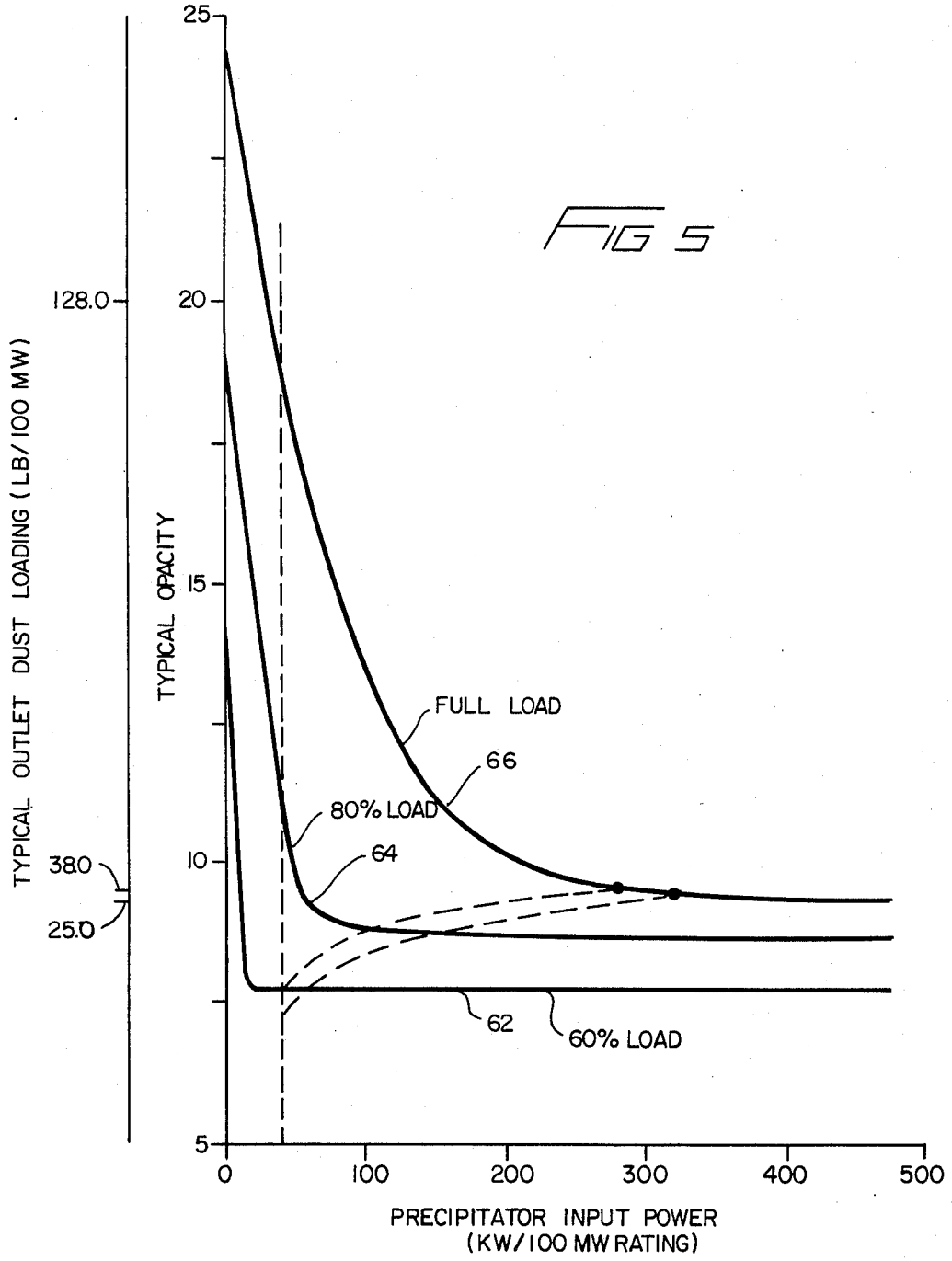
FIG. 5 is a plot of several opacity versus power curves.

FIG. 5 discloses curves 62, 64 and 66 which relate the opacity to field power. Curve 62 is representative of opacity readings obtained when a precipitator, such as precipitator P, is operating at 60% load. Similarly, curves 64 and 66 relate to precipitator loadings of 80% and 100%, respectively. Obviously, these curves are illustrative as the actual curves will be related to the precipitator being operated. It can be noted that each of the curves 62–66 has a relatively flat portion at high power inputs. Each of the curves 62 through 66 has a knee associated with a dramatic change in opacity rating for a marginal change in power input. Consequently, the power which is input to the precipitator P can be continually decreased until the knee of the curve is reached. Once the knee is reached, the opacity increases greatly for each marginal decrease with the result that particular care must be taken to make sure that the power is not reduced below that level required to attain the environmental limit. It can be seen that the flat part of the curve extends over a wider power range as the load factor decreases. Additionally, the opacity increases dramatically as the power approaches zero due to the fact that few particles are being removed from the flue gas stream. This it to be expected in view of the denseness of the particulates exiting the boiler B.

The primary controller 44 directs the T-R sets 26–W-30 to provide a predetermined amount of power for charging the discharge electrodes of precipitator P. The accumulation of particulates on the electrodes of precipitator P affects the voltage and current of the collecting electrodes. Consequently, while the primary controller 44 may direct the T-R sets 26–30 to provide a certain power level, the accumulation of particulates results in a different voltage and current level being actually realized because the T-R sets 26–30 tend to hold the current, voltage or phase angle constant for the particular idealized power demanded. The power monitor 56, which is of a type well known in the art, monitors the power between the electrodes of the precipitator P, or the electrodes of each field P1, P2 and P3, and communicates the measured power or voltage to the primary controller 44. The controller 44 continuously compares the idealized or theoretical voltage or current for a given power level versus the actual field voltage or current as a means for monitoring the accumulation of particulates on the electrodes. After a sufficient number of particulates have accumulated on the electrodes 14–24 of the precipitator P, then the electrodes must be cleaned or rapped, in a way well known in the art, in order to restore the precipitator P, or at least the individual fields P1, P2 and P3, to efficient operation.

As best shown in FIG. 1, each of fields P1, P2 and P3 has a rapper mechanism 68 which is in electrical connection with rapper controller 70. Rapper controller 70 is in electrical connection with primary controller 44 and the rapper controller 70 is responsive to control signals directed from the primary controller 44 for causing the rappers 68 to selectively rap the fields P1, P2 and P3.

A transient monitoring transducer 72 is preferably operatively associated with boiler B, preferably through duct 10. Transducer 72 is adapted for providing a signal indicative of any one of flue gas temperature, particulate resistivity, field dielectric strength and electrode cleaning. The transducer 72 directs a signal indicative of the variable being monitored to the primary controller 44 to permit the primary controller 44 to regulate the field voltage in response to fluctuations in the signal.

Figure 3:
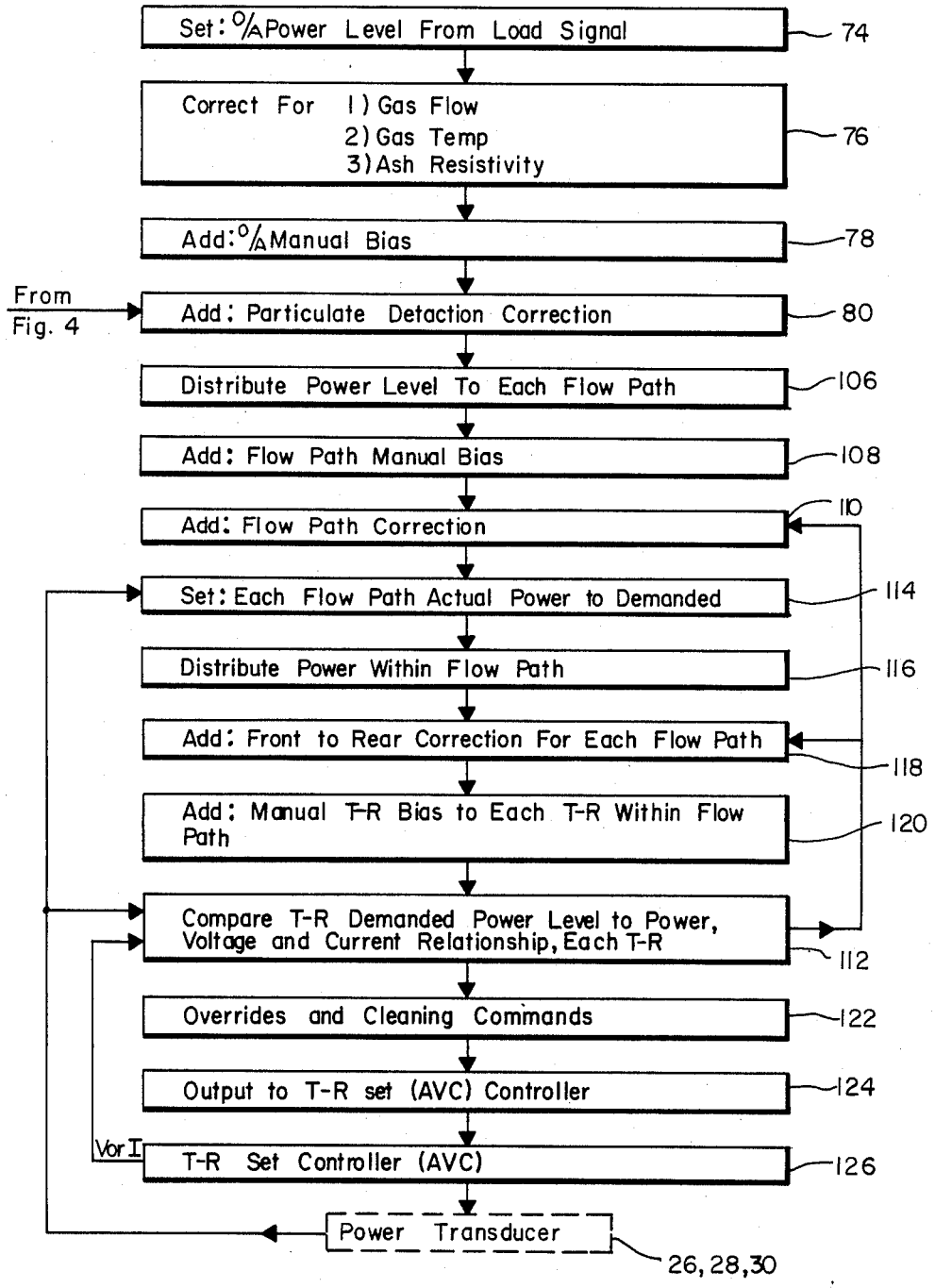
FIGS. 3 and 4 are functional logic diagrams illustrating the algorithms utilized by the invention.
Figure 4:
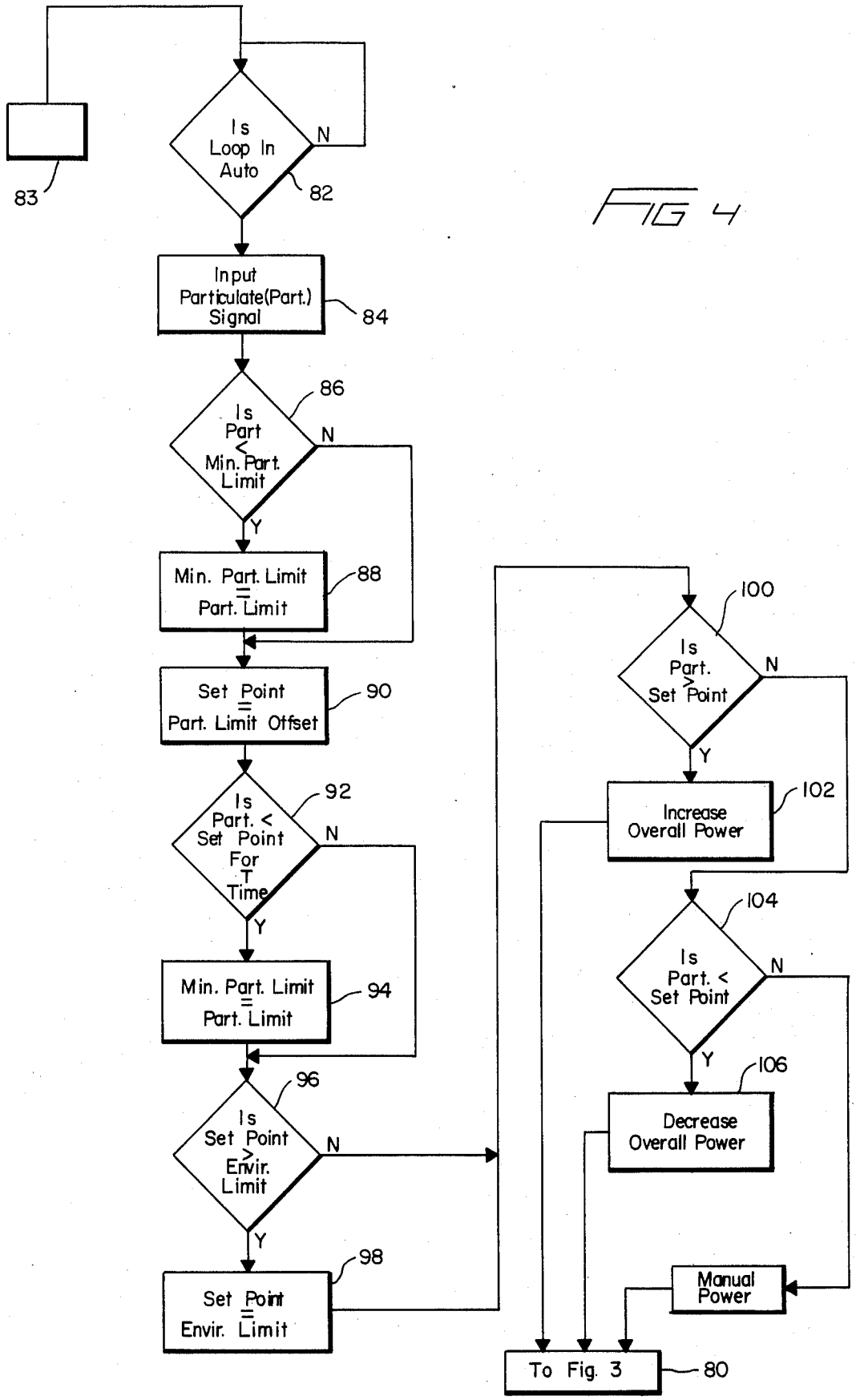

The logic sequence utilized for operating the invention is best shown in FIGS. 3 and 4. The logic sequence may be thought of as an algorithm which is utilized to obtain the necessary data, to perform the necessary functions on the data and to utilize the processed data for the purpose of regulating the power output of the T-R sets 26–30.

Initially, the environmental limit for particulates and the particulate offset are input through the data input device 58. The environmental limit permits primary controller 44 to determine a minimum field power. The feed forward load indexed signal produced by the transducer 52, in cooperation with the preestablished environmental limit, permits the primary controller 44 to determine the appropriate power needed to assure that the precipitator P adequately cleans the flue gas, particularly during start-up of the boiler B.

The feed forward load indexed signal of transducer 52 is input to the primary controller 44 at step 74, as best shown in FIG. 3. The overall field power required is determined, as previously described, based upon the load indexed signal which is fed forward from transducer 52. Generally, a precipitator, such as precipitator P, includes a number of cooperating pairs of electrodes, such as electrode pairs 14–16, 18–20 and 22–24. The cooperating pairs of electrodes each serve to define a field, such as fields P1, P2 and P3, respectively. The primary controller 44 establishes the total field power which is necessary for the combination of the fields, P1, P2 and P3.

The overall field power is corrected at 76 for any one of flue gas flow, casing particulate loading, flue gas temperature, or resistivity. Generally, the correction for variations in flue gas flow will be based upon analysis of historical data. Typically, manual correction will be provided, the amount of which will be determined from the data and which will be related to the precipitator P being utilized. The flue gas temperature correction, on the other hand, is based upon a realization that a higher temperature will result in a higher volumetric flow. This data is relatively easy to collect. Finally, the correction for ash resistivity will also be historically based and will be dependent, at least in some part, on the particulate material being combusted. Those skilled in the art know that coal, as an example of one particulate source, is an amorphous material which consists essentially of numerous organic constituents. The resistivity of the ash of the coal will depend, to a large extent, on the grade and type of coal being combusted. The overall field power can also be corrected at 78 by a manual bias. The manual bias will be based, at least in part, upon operator experience with the particular precipitator P being utilized.

The algorithm next corrects the overall power demand signal at 80 based upon the feedback signal from the transducer 54. The signal from the transducer 54 is manipulated by the algorithm of FIG. 4, and will be further explained, and is input to the logic sequence at 80. Suffice it to say at this point, that the signal of the transducer 54 is operated on by an integrating controller.

The integrating controller is best shown in FIG. 4 and is utilized for correcting the overall demanded power signal by biasing the signal up or down to maintain the opacity at a particular level. The opacity setpoint signal is determined by the low-seeking algorithm of FIG. 4 and optimizes the power/particulate level relationship. This low-seeking algorithm incorporates an allowable offset limit setpoint. The environmental limit setpoint overrides the low-seeking algorithm of FIG. 4 in the event that the precipitator P performance is in the vicinity of the environmental limit. The environmental limit setpoint and the allowable offset limit setpoints are, as previously discussed, input to primary controller 44 by data input device 58.

The algorithm of FIG. 4 determines, at 82, whether or not the loop is in automatic control or on manual by interpreting a signal from switch controller 83. The algorithm next receives the particulate signal at 84 from the opacity transducer 54. Comparator 86 manipulates the signal from the transducer 54 and compares that signal with a prevously stored minimum particulate limit signal related to a previously achieved low opacity level. The comparator 86 determines whether the particulate loading signal transmitted by the transducer 54 is less than the stored particulate limit signal. Should the particulate loading signal be less than the stored particulate limit then the algorithm at 88 sets the stored particulate limit signal as being equal to the particulate loading signal. Basically this operation indicates that the particulate loading signal is less than the previously achieved stored minimum particulate level. Consequently, function 88 indicates that the particulate loading signal is less than that previously obtained, although not necessarily the lowest obtained level, and indicates that a reduction in corona power of the electrodes has not deleteriously affected the measured opacity.

Should the particulate loading signal be greater than or equal to the previously stored minimum particulate signal, then the operation of function 88 will be bypassed. The algorithm next calculates a setpoint signal which is equal to the particulate limit signal plus the previously input particulate offset signal. The particulate limit, as previously described, represents a previously obtained low opacity level which has been stored in storage device 60. The setpoint signal is then transmitted to comparator 92 where the particulate loading signal is compared with the setpoint signal. Should the particulate loading signal be less than the setpoint signal then the comparator 92 outputs the resulting signal to 94 and replaces the previously stored minimum particulate limit signal with the particulate loading limit. In other words, the previously stored low opacity value has been replaced due to the fact that the particulate loading signal is less than the setpoint signal. This indicates that the opacity did not increase more than the acceptable range which is established by the particulate offset signal.

Should the particulate loading signal be greater than or equal to the setpoint signal, then the algorithm bypasses the operation of 94 and the signal is transmitted to comparator 96 wherein the setpoint is compared with the environmental limit which has been input through by data input device 58. Should the setpoint exceed the environmental limit signal then the setpoint is set equal to the environmental limit at 98.

The algorithm next compares the particulate loading signal to the setpoint signal at comparator 100. Should the particulate loading signal exceed the setpoint signal then the algorithm at 102 directs that the corona power be increased by a uniform increment voltage amount at 102. The increased corona power signal is then output to the particulate detection correction at 80, FIG. 3.

Should the particulate loading signal not exceed the setpoint, then the algorithm compares the particulate signal to the setpoint at comparator 104. Should the particulate loading signal be less than the setpoint signal then the algorithm, at 106, directs that the corona power be decreased by a uniform voltage amount. The output of the algorithm of FIG. 4 is input to the particulate detection correction 80 of FIG. 3, as previously described.

The low-seeking algorithm, as best shown in FIG. 4, optimizes the particulate level setpoint by adjusting the power level down until the predetermined offset in particulate loading has been obtained. Should the particulate loading exceed the maximum allowable particulate level, then the setpoint directs that the corona power be increased. The low particulate level previously obtained is stored in storage 60 for reference as a target particulate level. The process and the control are both dynamic and cycling occurs. Cycling is used to assure that the minimum power level for the target particulate level is achieved. As the cycling occurs, the stored minimum particulate level is continually updated from the particulate detection signal.

Should the load increase, or other factor, cause the target opacity to be exceeded for more than predetermined period of time, while the primary controller 54 has increased power to a predetined limit, then the stored target particulate level is replaced by the actual particulate level plus the predetermined allowable offset. This action resets the algorithm which again performs the low-seeking power routine. This method prevents the particulate control from oscillating between the predefined particulate limits and permits continual operation very near the optimal level.

The particulate detection correction can be placed into or taken out of service by a manual or an automatic selector station. This capability permits operation in accordance with the load indexed feed forward signal when the opacity transducer 54 is being maintained or is not operating properly.

One skilled in the art can appreciate that various upsets and transient distortions may occur in the operation of boiler B with the result that the emissions from stack S may be non-linear. The particulate sampler, such as optical transducer 54, therefore preferably includes means for averaging the measured particulate level over a preselected period of time in order to minimize temporary distortions and transients. Consequently, the dynamic signal being transmitted by the optical transducer 54 is not a real time signal but is actually an averaged signal. A similar feature may also be provided for the load indexed transducer 52 to also minimize the distortions and fluctuations of the parameters being measured. Furthermore, the lead time from input upset to its effect on the stack S may be compensated for by the controller 44 means of a time delay.

The primary controller 44 determines the flow path power levels at 106 and directs the individual T-R sets 26–30 to provide the necessary power for obtaining that total corona power. A manual flow path bias at 108 may be adjusted for each flow path. The primary controller 44 also includes means for automatically biasing the flow path at 110 for achieving the maximum removal effect in each flow path.

The particulate buildup detection algorithm, at 112, is used for automatic correction of the effects of particulate accumulation through monitoring the rate of build-up in the front fields for each flow path. The power level demanded for each flow path is compared to the actual power utilized in the flow paths at 114. An integrating controller assures that the feed back signal representing the power utilized is equal to the power demanded signal. The power to the flow paths is distributed at 116.

Figure 6:
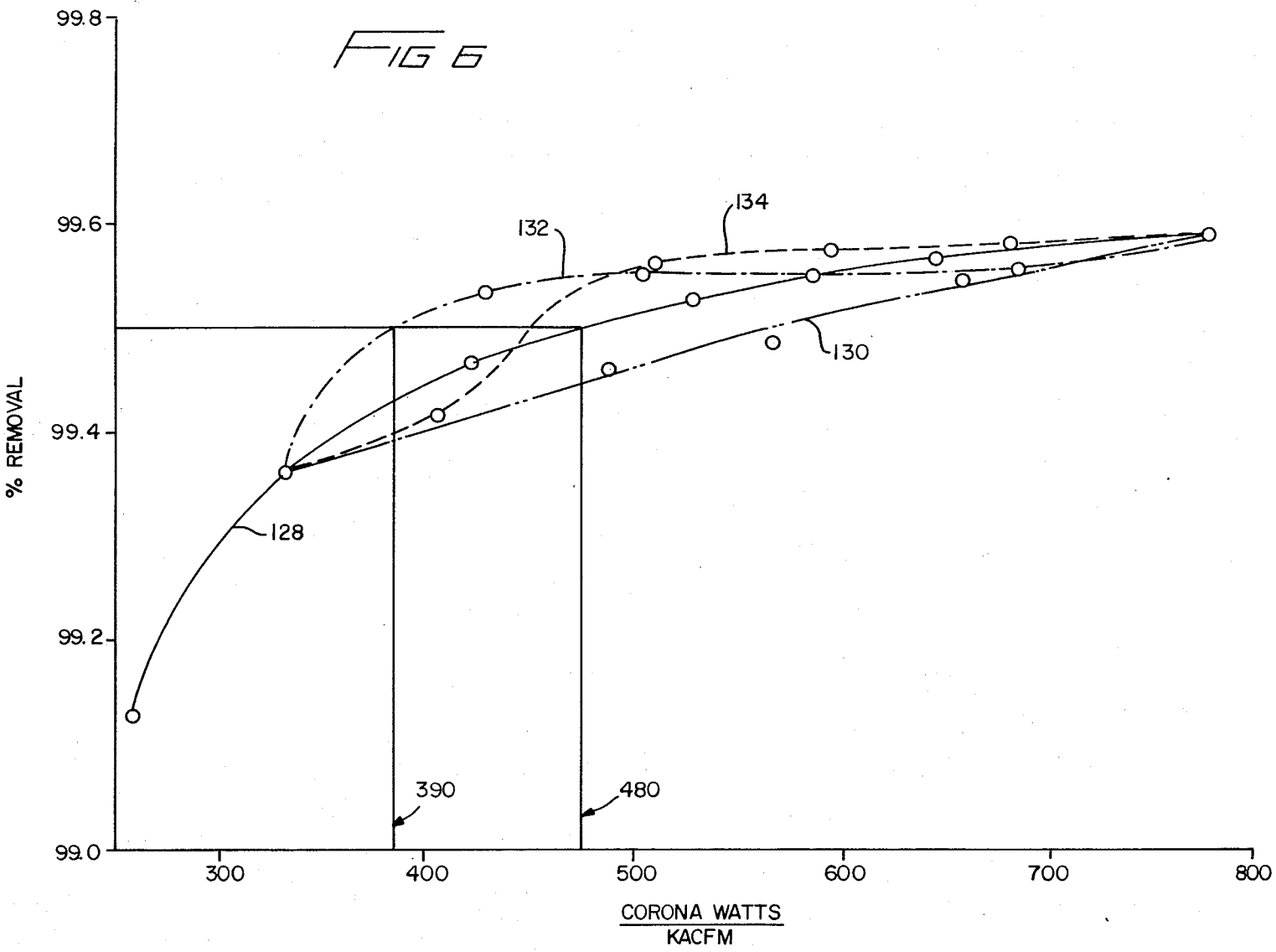
FIG. 6 is a plot disclosing the effects of profiling of the precipitator fields.

The flow control also includes means for biasing the individual fields, P1, P2 and P3, from the front of the flow path to the rear at 118. This helps to achieve the optimal removal effect in each flow path. FIG. 6, which discloses the effects of profiling, shows that biasing of the T-R fields depends upon the actual precipitator used. The biasing is based upon modeling utilizing the Deutsch-Anderson model in conjunction with historical data. The particulate build-up detection algorithm 112 is used for automatically correcting the demanded power distribution within the flow path.

The individual demanded power levels can be manually biased, at 118, for operational flexibility. A manual bias is provided at 120 and permits manual adjustment in the event of transient distortions.

The primary controller 44 utilizes the algorithm at 112 for monitoring the particulate build-up of the electrodes 14–24 in the precipitator P. A voltage or current monitor, such as monitor 56, is connected between each pair of oppositely charged electrodes 14–16, 18–20 and 22–24, and monitors the voltage between the electrodes. Experience has indicated that the accumulation of particulates on the electrodes 14–24 results in a decreasing resistance between the electrodes. Consequently, while the primary controller 44 is directing individual T-R sets 26–30 to provide an amount of power previously determined to be sufficient to generate a predetermined field power, the accumulation of particulates results in the actual voltage level being less than the idealized voltage. Consequently, the current level is greater than the idealized current. At some point, the resistance decreases to such a point that the electrodes 14–24 must be cleaned. Those skilled in the art realize that the rate of particulate build-up on the cooperating pairs 14–16, 18–20 and 22–24 uniform with the result that one pair of electrodes, such as 14–16 may require cleaning prior to the remaining electrodes 18–24. Consequently, monitoring the field voltage or current of the individual fields P1, P2 and P3 provides an accurate measurement for determining when the electrodes 14–24 must be cleaned. Also, a comparison of the idealized voltage or current versus the actual utilized voltage or current permits a determination to be made as to whether or not the cleaning process was sucessful or the field is operating properly. Failure of the voltage or current to return to the idealized level after cleaning generates a cleaning failure alarm.

A power increase for one of the pairs of electrodes 14–24 permits an accurate measurement to be made of when the electrodes 14–24 must be cleaned. The means for rapping or cleaning the electrodes are well known in the art and the rapper controller 70 is directed at 122 to cause rapping by one or several of the rappers 68. Further discussion of the rapper mechanism 68 is not deemed necessary. The power level of the fields P1, P2 and P3 being cleaned is maintained, reduced or deenergized depending upon the characterics of the particulates being removed.

Should the utilized voltage after cleaning be less the idealized voltage determined by the T-R set excitation, then the algorithm provides for an alarm to be transmitted in order to notify the appropriate personnel. A system of alarms permits ready determination of the malfunction.

The algorithm, at 124, outputs a control signal to each T-R set 26–30. The signal is normally a current limit, a voltage limit, or a firing angle limit override which regulates the power output of the T-R sets 26–30 at 126.

Figure 2:
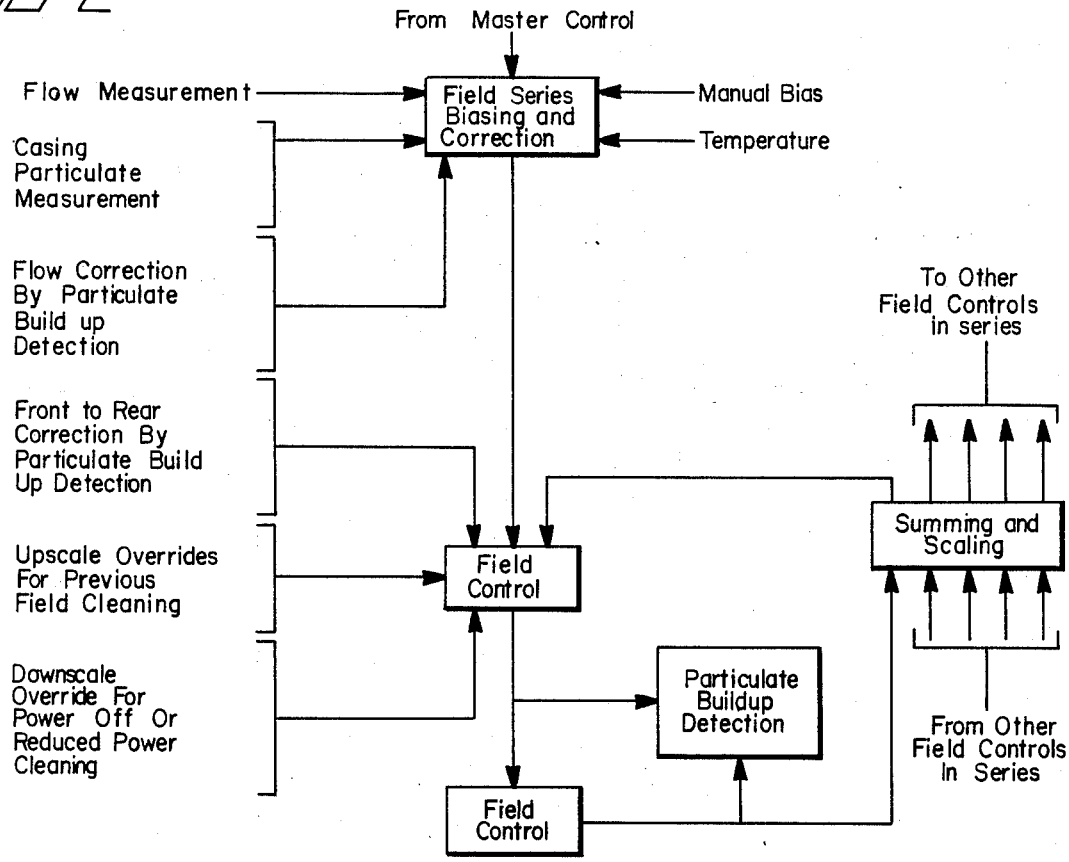
FIG. 2 is a functional block diagram of the invention.

The functional diagram disclosed in FIG. 2 indicates in block form the various functions and corrections provided by the algorithms of FIGS. 3 and 4. A master control, such as the main control of the precipitator P, is in electrical connection with primary controller 44.

Primary controller 44, which includes a microprocessor or the like, directs the field series biasing and correction for the individual fields of the paired electrodes 14–16, 18–20 and 22–24 of the precipitator P. The primary controller 44 includes means for correcting the primary field power for flow measurement of flue gas, for casing particulate measurement in the flue gas, for temperature of the flue gas and provides manual bias based upon empirical relationships. The primary controller 44 also includes a flue gas correction to accomodate the build-up of particulates on electrodes 14–24. As can be appreciated, the primary controller 44 provides means for automatically arithmetically accurately approximating the overall field power which the precipitator P must have if the measured particulate level is to be approximately that of the target level with the lowest power input. It is important that the initial primary field power be close to the required field power if the algorithms of FIGS. 3 and 4 are to be accurately and efficiently utilized for minimizing the power consumption of the precipitator P.

The field controls also include an upscale override in the event one of the upstream fields is being cleaned. One skilled in the art can appreciate that rapping of the electrodes 14–24 by the rapper mechanism 68 results in the evolution of large amounts of particulates. These particulates could result in a spurious signal directing the primary controller 44 to unnecessarily increase the field voltage by a large amount. The upscale overrides are only operational during the cleaning of the individual electrodes. The field controls also contain a downscale override for power off or reduced power rapping.

The field controller includes means for transmitting the particulate build-up to the primary controller 44 so as to rap or clean the individual electrodes 14–24 when that becomes necessary.

The primary controller 44 also controls the total power to be given any flow path. Thus, the primary controller 44 automatically adjusts the total power in a given flow path to compensate for action taken in cleaning. Additionally, the primary controller 44 compensates in the event that a T-R set 26–30 is lost for any reason. It can be seen in FIG. 2 that a number of paired electrodes 14–24 are provided in the precipitator P. The primary controller 44 is adapted for monitoring each of the individual field controls and for summing and scaling the results obtained therefrom so as to optimally provide the requisite power for precipitator P. Each of the field controllers is in communication with the field controllers of the other electrodes so that a working network is provided.

FIG. 6 discloses the effects of profiling or biasing fields P1, P2 and P3 in a flow path for a specific precipitator P. The ideal profile would be determined for each precipitator by tests and computer modeling.

Curve 128 represents a uniform power reduction curve. Curve 130, on the other hand, represents the effect of profiling the fields P1, P2 and P3 in a certain way. Similarly, curves 132 and 134 likewise show the effects of profiling.

A review of FIG. 6 discloses the beneficial effects of profiling the fields P1, P2 and P3. It can be seen that curve 132 provides a greatly improved removal efficiency at a voltage level wherein the remaining curves 130 and 134 provide for a reduced removal. Similarly, curve 134 provides for reduced removal efficiency at relatively low power levels but removal efficiency is greater increased at higher levels. It can be noted, however, that all curves 128–134 eventually obtain the same removal efficiency at maximum field power. Consequently, the effects of profiling are more substantial at low power operation.

OPERATION

Utilization of the invention is relatively straightforward and is readily adapted for both new installations and retrofitting. The primary controller 44, the data input device 58 and the storage device 60 may, preferably, be integrated into a single unit which may also have the capability for handling the data collection from transducers 52 and 54 and the transient transducer 72. Consequently, the space requirements are relatively small.

The system operator (not shown) inputs the particulate offset level and the environmental limit into the primary controller 44 through the data input device 58. Typically, precipitators, such as precipitator P, are designed to remove in excess of 99.6% of the particulates and therefore it is not necessary to input a removal efficiency parameter. The removal efficiency parameter may, however, be included in the algorithm. After the particulate offset and the environmental limits have been received and stored in the storage device 60, then the system is ready for operation.

The feed forward lead indexed transducer 52 transmits its signal to the primary controller 44. The primary controller 44 determines the field power which is required in order that the flue gas exiting the stack S not exceed the precipitator's capability and be less than the environmental limit. The primary controller utilizes the algorithm of FIG. 3 for determining the field power and directs the T-R sets 26–30 to provide the requisite power. This demanded power is sufficient to permit the flue gas exiting the stack S to not exceed the environmental limit. The demanded power may, however, be more than is optimally required with the result that the trim algorithm of FIG. 4 is then utilized.

The opacity transducer 54 feeds back a particulate loading signal to the primary controller 44 which utilizes the algorithm of FIG. 4 to trim the power. The power is continually uniformly incrementally decreased until such time as the opacity exceeds the previously obtained opacity by more than the allowable offset. The primary controller, once beyond or less than the power level associated with the knee of the curves of FIG. 5, directs the T-R sets 26–30 to increase the power and thereby bring the opacity into range. The algorithm of FIG. 4 causes the T-R sets 26–30 to follow the base or flat portion of the curves 62–66 until such time as a marginal decrease in power causes the opacity to increase by a large amount.

The algorithm of FIG. 4 stores a low opacity level which has been obtained at a particular power input. The algorithm then lowers or incrementally decreases the power and then compares the measured opacity to the stored opacity. Should the measured opacity be less than the stored opacity plus the particulate offset, then the measured opacity replaces the stored opacity. The algorithm continues to repeat this process until the measured opacity exceeds the stored opacity by more than the particulate offset.

It can be seen, therefore, that the load indexed transducer 52 provides an accurate determination of the power required by the electrodes 14–24 to clean the flue gas so as to obtain at least the environmental limit. The feed back particulate loading transducer, on the other hand, causes the field power to be trimmed or incrementally decreased so that the resulting opacity is, generally, much better than the environmental limit but, on the other hand, the power required may be greater than the power required to attain the environmental limit. The use of the feed back particulate loading transducer, therefore, represents a tradeoff between reduced power consumption and a cleaner environment. The cleaner environment also, however, results in decreased operating costs for the precipitator P and stack S. The reduced operating costs are due to the fact that a cleaner flue gas stream causes less damage to the induced draft fans and other operating components.

While this invention has been described as having a preferred design, it is understood that it is capable of further modifications, uses and/or adaptions of the invention following in general the principles of the invention and including such departures from the present disclosures as come with the known or customary practice in the art to which the invention pertains and as may be applied to the central features hereinbefore set forth, and fall within the scope of the invention of the limits of the appended claims.

What we claim is:

1. A process for optimizing the power comsumption of an electrostatic precipitator communicating with a boiler comprising the steps of:

(a) providing a controller regulating field power of a precipitator;

(b) establishing a particulate offset and an environmental limit for particulates and feeding same to said controller;

(c) generating a signal indicative of a boiler load and feeding said signal forward to said controller for regulating the field power of the precipitator;

(d) generating another signal indicative of a particulate loading of a flue gas exiting the precipitator and feeding said another signal back to said controller;

(e) establisning a setpoint defined by the lesser of said environmental limit for particulates and a sum of said particulate offset and a stored particulate limit; and, (f) comparing said another signal with the setpoint and causing said controller to incrementally trim the field power by decreasing the field power and replacing said particulate limit with said another signal when said another signal is less than the setpoint and increasing the field power when said another signal exceeds the setpoint.

2. The process as defined in claim 1, including the step of:

(a) generating said another signal with a particulate detection means.

3. The process as defined in claim 2, including the step of:

(a) generating said another signal with an optical transducer.

4. The process as defined in claim 1, including the step (a) generating said signal with a load monitoring transducer.

5. The process as defined in claim 4, including the step of:

(a) generating said first mentioned signal by monitoring at least any one of volumetric flue gas flow, ash loading, ash resistivity, volumetric steam flow, volumetric field flow and flue gas temperature.

6. The process as defined in claim 1, including the further step of:

(a) correcting the field power for a change in any one of flue gas temperature, boiler load, particulate resistivity, field dielectric strength and electrode cleaning.

7. The process as defined in claim 1, including the further step of:

(a) averaging said another signal over a preselected time period.

8. The process as defined in claim 1, including the step of:

(a) trimming the field power by uniform incremental power changes.

9. The process as defined in claim 1, including the further step of:

(a) generating an alarm signal when said another signal exceeds the setpoint by more than a predetermined amount.

10. The process as defined in claim 1, including the step of:

(a) preventing the field power from being increased beyond a preselected upper power level.

11. The process as defined in claim 6, including the further step of:

(a) delaying correction of the field power for a preselected time period.

12. The process as defined in claim 1, including the further steps of:

(a) measuring the field voltage or current; and, (b) comparing said measured field voltage or current to an ideal field voltage or current for a given power for thereby determining the amount of particulates attached to the electrodes of said precipitator.

13. The process as defined in Claim 12, including the further steps of:

(a) deenergizing the precipitator and thereby the electrodes when said measured or calculated field voltage exceeds said ideal field voltage by more than a predetermined amount;

(b) rapping the electrodes for thereby removing said particulates; and, (c) reenergizing the precipitator.

14. The process as defined in claim 1, including the further steps of:

(a) providing the precipitator with a plurality of precipitator units; and, (b) providing each of the precipitator units with a field power regulator connected to and cooperating with said controller for thereby permitting independent energization of the elctrodes of the precipitator units.

15. The process as defined in claim 14, including the step of:

(a) energizing the electrodes of the precipitator with a transformer-recitifer.

16. The process as defined in claim 14, including the further step of:

(a) biasing at least one of the precipitator units to thereby provide a field power for the biased unit exceeding the field power of the remaining precipitator units.

17. The process as defined in claim 14, including the steps of:

(a) arranging the units in sequenctial or parallel relation between the inlet and the outlet of the precipitator; and, (b) profiling the field power of the units so that the field power of the unit adjacent the inlet exceeds the field power of the unit adjacent the outlet.

18. A process for optimizing the power consumption of an electrostatic precipitator communicating with a boiler, comprising the steps of:

(a) providing a boiler unit, a preciptitator unit having electrodes and an exhaust unit and with said units being in flow communication for transmitting a flue gas from said boiler unit to said exhaust unit;

(b) providing adjustable power supply means in electrical connection with said electrodes of said precipitator unit for energizing said electrodes;

(c) providing a controller in electrical connection with said power supply means for adjusting said power supply means and regulating the field power of said precipitator unit;

(d) establishing a particulate offest and an environmental limit for particulates;

(e) generating a signal indicative of the boiler unit load and feeding said signal forward to said controller for thereby causing said controller to adjust said power supply means and to therefore regulate the field power of said precipitator unit;

(f) generating another signal indicative of the particulate loading of the flue gas passing through said exhaust unit and feeding said another signal back to said controller;

(g) establishing a setpoint equal to the lesser of said environmental limit for particulates and the sum of said particulate offset and a stored particulate limit; and, (h) comparing said another signal with the setpoint and causing said controller to adjust said power supply means for thereby incrementally trimming the field power by decreasing the field power and replacing said particulate limit with said another signal when said another signal is less than the setpoint and increasing the field power when said another signal exceeds the setpoint.

19. The process as defined in claim 18, including the step of:

(a) providing the field power through a transformer-recitifier set.

20. The process as defined in claim 18, including the step of:

(a) monitoring at least one of volumetric flue gas flow, ash loading, ash resistivity, volumetric steam flow, volumetric field flow and flue gas temperature.

21. The process as defined in claim 18, including the step of:

(a) monitoring the particulate loading with an opacity transducer.

22. The process as defined in claim 18, including the further step of:

(a) correcting the field power for a differential change in at least any one of flue gas temperature, boiler load, particulate resistivity, field dielectric strength and electrode cleaning.

23. The process as defined in claim 18, including the further step of:

(a) trimming said field power by preselected uniform incremental power levels.

24. The process as defined in claim 18, including the further step of:

(a) generating an alarm signal when said another signal exceeds said environmental limit by more than a preselected amount.

25. The process as defined in claim 18, including the step of:

(a) providing said controller with means for preventing the field power from being increased beyond a preselected upper power level.

26. The process as defined in claim 22, including the further step of:

(a) delaying correction of the field power for a preselected time period.

27. The process as defined in claim 18, including the further step of:

(a) measuring the field voltage or current; and, (b) comparing the measured field voltage or current with an ideal field voltage or current for thereby determining the amount of particulates attached to said electrodes of said precipitator unit.

28. The process as defined in claim 27, including the steps of:

(a) deenergizing the electrodes of said precipitator when said measured or calculated voltage exceeds said ideal voltage by more than a predetermined amount;

(b) cleaning said particulates from the electrodes of said precipitator; and, (c) energizing said electrodes of said precipitator unit.

29. The process as defined in claim 18, including the further steps of:

(a) providing said precipitator with a plurality of precipitator units; and, (b) providing each of said precipitator units with a field power regulator means connected to and operably associated with said conroller for thereby permitting independent energization of said electrodes of each of said units.

30. The process as defined in claim 29, including the further step of:

(a) biasing the electrodes of at least one of said units to a power exceeding that of the electrodes of the other units.

31. An apparatus for optimizing the power consumption of an electrostatic precipitator cleansing a particulate laden flue gas stream exhausted by a boiler to an exhaust device wherein the precipitator includes at least one pair of electrodes for charging and collecting particulates, comprising:

(a) controller means for electrical connection with the electrodes for providing a field voltage between the electrodes and for regulating the field power;

(b) load monitoring means associated with a boiler and in electrical connection with said controller means for monitoring the boiler load and for generating a signal indicative of the boiler load and feeding said signal forward to said controller means for causing said controller to provide a field power;

(c) particulate monitoring means associated with an exhaust device and in electrical connection with said conntroller means for monitoring the particulate loading of flue gas exiting the precipitator and for generating another signal indicative of the particualte loading and for feeding said another signal back to said controller means;

(d) said controller means includes means for storing a particulate offset, an environmental limit for particulates and a particulate limit;

(e) said controller means further includes computation means for generating a setpoint equal to the lesser of said environmental limit for particulates and the sum of said particulate offset and a stored particulate limit whereby said controller means may incrementally trim the field power by decreasing the field power and replacing said stored particulate limit with said another signal when said another signal is less than the setpoint and by increasing the field power when said another signal exceeds the setpoint.

32. The apparatus as defined in claim 31, wherein:

(a) said load monitoring means includes a transducer adapted for monitoring at least any one of volumetric flue gas flow, ash loading, ash resistivity, volumetric steam flow, volumetric field flow and flue gas temperature.

33. The apparatus as defined in claim 31, wherein:

(a) said particulate monitoring means includes an optical transducer.

34. The apparatus as defined in claim 31, wherein:

(a) said controller means includes means for correcting the field power for a change in any one of flue gas temperature, boiler load, particulate resistivity, field dielectric strength and electrode cleaning.

35. The apparatus as defined in claim 33, wherein:

(a) said optical transducer includes means for averaging the particulate loading over a preselected time period.

36. The apparatus as defined in claim 31, wherein:

(a) an alarm is provided for said controller means whereby said controller means is adapted for operating said alarm when said another signal exceeds said environmental limit by more than a preselected amount.

37. The apparatus as defined in claim 31, wherein:

(a) said controller means adapted for preventing an increase of the field voltage beyond a preselected upper voltage level.

38. The apparatus as defined in claim 31, further comprising:

(a) voltage or current measuring means associated with said precipitator and in electrical connection with said controller means for measuring the field voltage or current; and, (b) said controller means adapted for comparing said measured or calculated field voltage to an ideal field voltage to thereby permit determination of the amount of particulates attached to the electrodes of said precipitator.

39. The apparatus as defined in claim 31, wherein:

(a) said precipitator includes a plurality of precipitator units; and, (b) field voltage regulating means are associated with each of said units and are connected to said controller means for permitting independent energization of the electrodes of each of said units.

40. The apparatus as defined in claim 39, wherein:

(a) said field power regulating means includes a transformer-rectifier set.

* * * * *